United States Patent [19]

Hensley

[11] 4,113,194

[45] Sep. 12, 1978

[54] TRAVERSE BAR AND SLIDE

[75] Inventor: William G. Hensley, Daisy, Tenn.

[73] Assignee: Minnesota Mining and Manufacturing Company, St. Paul, Minn.

[21] Appl. No.: 743,463

[22] Filed: Nov. 19, 1976

[51] Int. Cl.[2] ..... B65H 54/30; B65H 57/00

[52] U.S. Cl. ..... 242/43 R; 242/18 R; 242/157 R

[58] Field of Search ..... 242/43 R, 43.1, 157 R, 242/18 R

[56] References Cited

U.S. PATENT DOCUMENTS

| | | | |
|---|---|---|---|
| 898,459 | 9/1908 | Gordon | 242/43 R X |
| 2,738,137 | 3/1956 | Breen | 242/43 R X |
| 3,858,818 | 1/1975 | Melz | 242/43 R |
| 4,033,520 | 7/1977 | Mims et al. | 242/43 R |

*Primary Examiner*—Stanley N. Gilreath
*Attorney, Agent, or Firm*—Cruzan Alexander; Donald M. Sell; Temple Clayton

[57] ABSTRACT

Traverse rod for the support of a thread guide in a winding machine rotatably secured in a slide preferably fitted with bumpers. Filled plastics are employed to decrease weight of the assembly. Fibrous glass fiber and polytetrafluoroethylene filled nylon-6 is preferred for the rod and self lubricating, i.e. molybdenum disulfide filled, nylon-6,6 for the slide. Significant decreases in the sound generation from typical winding machines is achieved using the traverse rod and slide combination.

2 Claims, 5 Drawing Figures

TRAVERSE BAR AND SLIDE

This invention relates to an improved traverse bar and slide and particularly for an improved traverse bar and slide for use in winding machines.

In many applications, such as in winding machines, reciprocating action is achieved by means of a slide having a projecting pin and cam rollers engaging in the grooved rim or a cam. Each complete revolution of the cam then results in one complete reciprocating cycle of any part cooperating with the slide. In winding machines for fibers, threads and the like, such as the Leesona 50 available from Leesona Corporation, Warwick, Rhode Island, the slide is attached to a traverse bar which carries a thread guide support and thread guide. The back of the thread guide support engages and rides on the upper edge of the traverse frame back which is not parallel to the traverse bar and its channel when cone packages are being wound so that it travels through a helical angle usually from about 3–10°. The lack of parallelism results in a slight torque being applied to the traverse bar with respect to the slide on each reciprocating cycle.

It has long been customary to make metallic traverse bars in various lengths and various styles to permit of variations, in the packages being wound. Common practice is to engage a metallic bar in a metallic slide by machine screws threads. It is found that a considerable generation of noise occurs during the reciprocating motion due to friction and rapid deceleration at each end of the cycle. Because of this, effort has been expended on producing traverse bars and sliders of various plastic materials which may decrease sound levels by decreasing the mass of the combinations. The efforts have not been successful apparently from failure to recognize the degradative effect exerted on the plastics by the repeated torques applied as described above.

It is an object of this invention to produce a slide and traverse bar combination for reciprocating motion which suppresses noise generation and is resistant to torques applied during reciprocating motion. Other objects will become evident herein elsewhere.

It has been found that a useful traverse bar and slide combination is obtained and significant decreases in sound level achieved when a traverse bar of suitable plastics is not rigidly affixed to the plastic slide but is rotatably secured therein. Different construction may achieve this result but the combination found especially suitable is to provide a longitudinal hole through the slide in which an extension of the traverse bar of slightly reduced diameter is received without excessive play and retain the traverse bar in the hole by suitable retaining means such as a C-clip in a slot in the traverse bar. The traverse rod may be stiffened by means of a metallic core. Although any plastic materials such as polyurethanes, polyesters, polyacrylates or methacrylates, polyolefins, polyamines, polycarbonates and the like can be used which are sufficiently tough, resilient and stiff and do not tend to fuse together under conditions of use, it is particularly preferred to use a nylon-6 filled with 30% glass fiber and 22% tetrafluoroethylene plastic for the traverse rod and 2.5 weight percent molybdenum disulfide filled nylon-6,6 for the slide. The cam roller is preferably of nylon-6,6 either similarly filled or not.

In preferred embodiments of the invention the traverse bar is integral with at least a bracket for attachment of a thread guide support which latter is conveniently of two parts a support and back plate or retainer plate.

The slide may be made as a single piece or if desired in two or more pieces. It is, of course, often advantageous to have single pieces which cannot come apart as a result of vibration during use but on the other hand separate pieces offer some convenience in assembly, maintenance and the like and may simplify problems of fabrication. In either event a preferred embodiment of the slide includes an upward extension having a hole for reception of a bumper at each end. The bumpers are so shaped and extend sufficiently that they tend to absorb at least a portion of the impact at the extremes of the reciprocating cycle. They are suitably made of a resilient elastomeric material such as rubber of about 50 durometer test. They assist in reducing noise level. A strike plate may be provided on the equipment at one or both ends of the traverse distance of the slide to absorb part or all of the shock of impact from the bumper and to compensate for the fact that the total distance of motion may be varied.

For convenience in manufacture, pieces of the combination such as traverse rod and bracket or slide may be injection molded as separate parts which are then attached using adhesives suitable for the plastic materials employed or by ultrasonic welding. The thread guide support may be attached by any convenient means such as by screws to the bracket on the traverse rod. Bumpers on the slides are inserted in holes or attached by other methods as is convenient.

Having described the invention in broad terms it is now more particularly described by reference to the drawings wherein.

Figure 1:
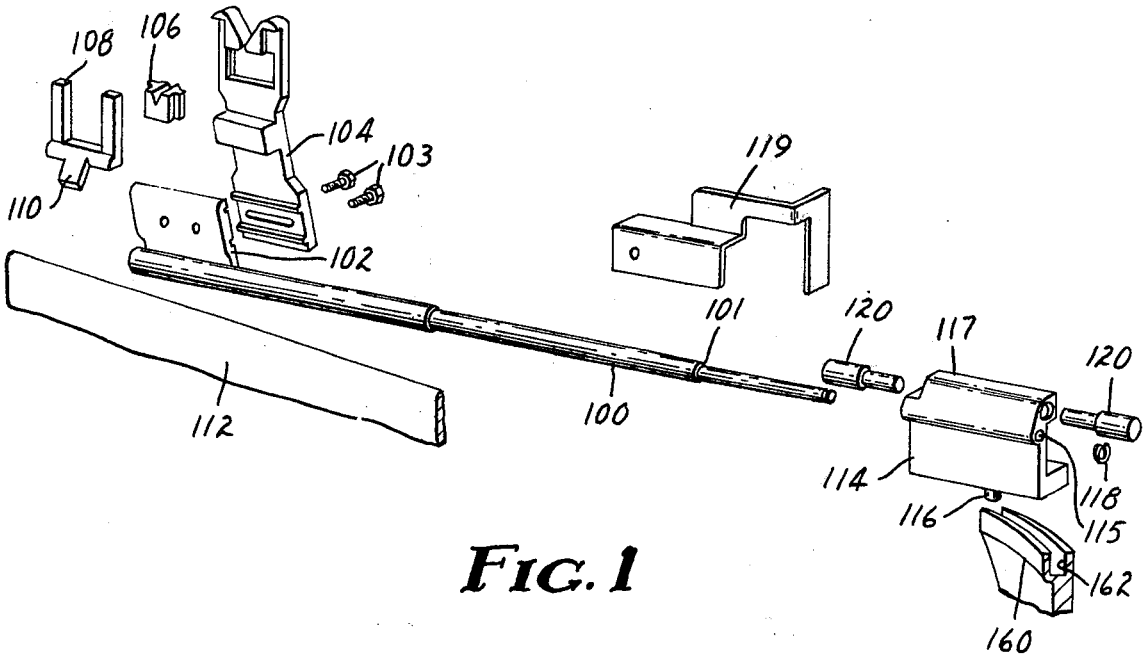
FIG. 1 is an exploded view of a traverse rod of the invention in combination with cam roller and thread guide.
Figure 2:
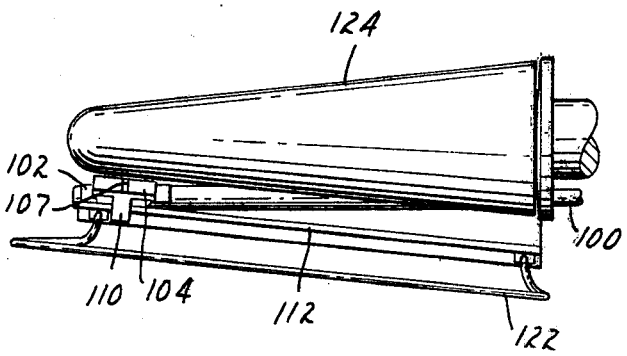
FIG. 2 is a view showing the relationship of the thread guide, winding coil and traverse frame back.

Referring again to the drawings, FIGS. 1 and 2 show a traverse rod of the invention 100 with bracket 102 for attachment by screws 103 of thread guide support 104 to which are attached thread guide 106 and thread guide clamp 108 with back guide 110 for guiding the thread guide 106 in relation to traverse frame back 112 threading bail 122 and winding cone 124 which is described in greater detail below in connection with FIGS. 3 and 4. In FIG. 2 thread guide clamp 108 is obscured by various parts.

The end of traverse rod 100 distal to bracket 102 is of smaller diameter so that it passes through hole 115 in slide 114 and is retained by C-clip 118. Shoulder 101 positions slide 114 so that there is no longitudinal play although rotation in slide 114 is free. Rotatability is an important feature of the invention. Upward projection 117 holds bumpers 120 which may be shouldered as shown or not and extend sufficiently to meet strike plate 119 or a portion of the frame at each extreme of motion.

Figure 3:
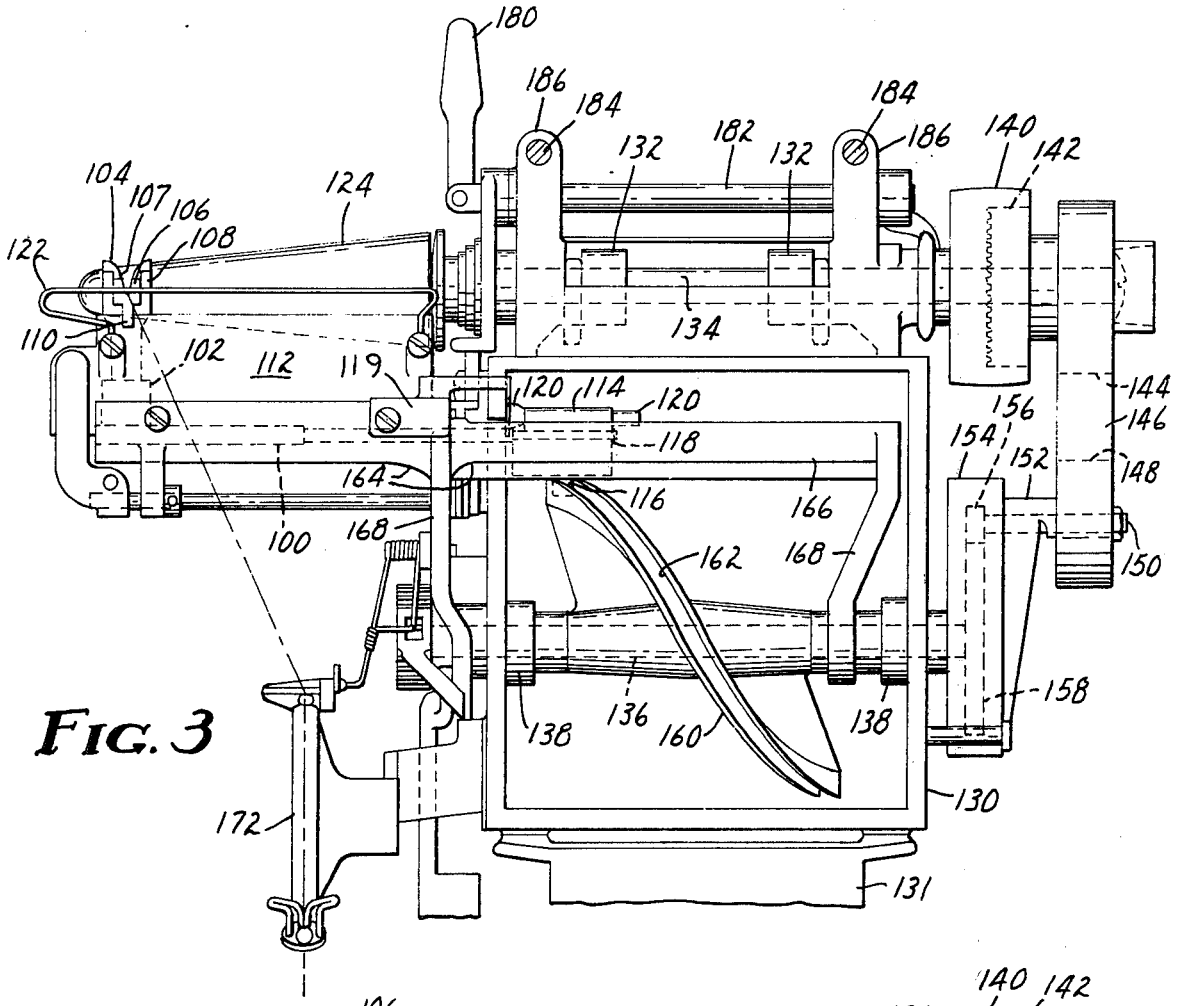
FIG. 3 shows a traverse rod of the invention with thread guide and cam roller in its relationship to a winding machine at one limit of motion.
Figure 4:
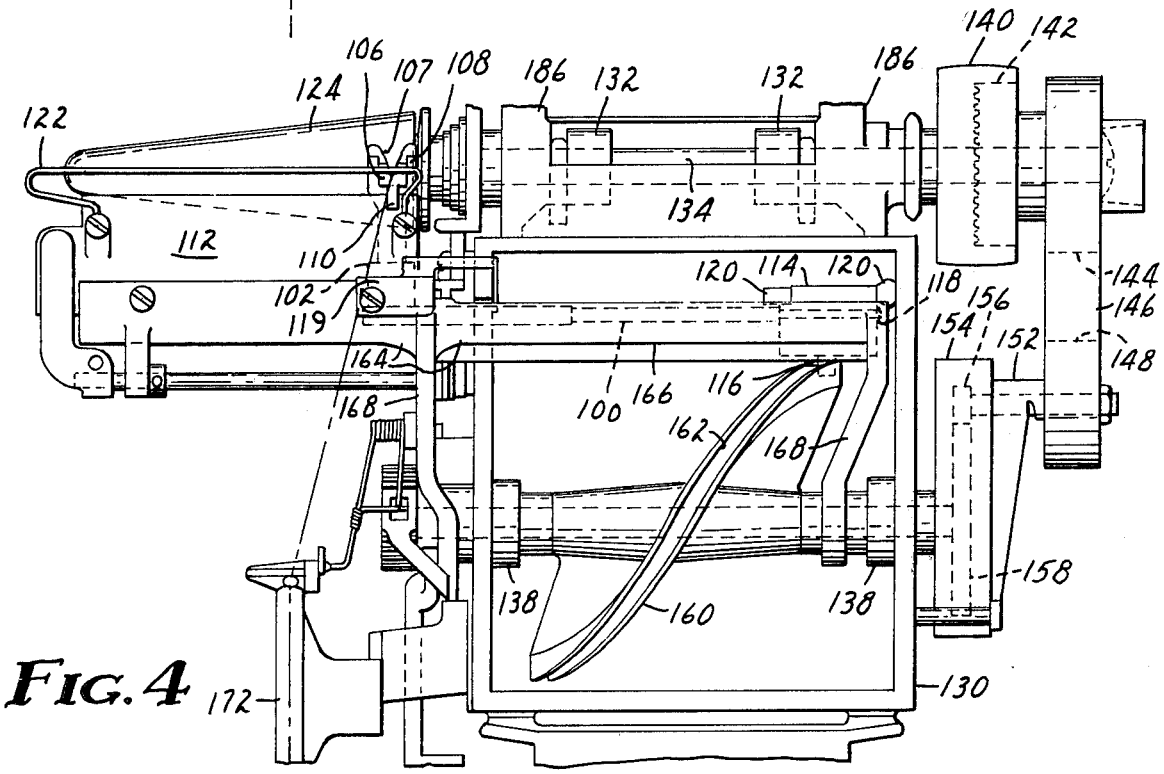
FIG. 4 shows a traverse rod of the invention as in FIG. 3 with portions of the winding machine omitted and with the traverse rod at the other limit of its motion.

Reference is now made to FIGS. 3 and 4 which show a winding machine in somewhat diagramatic form in order to show the manner in which the traverse rod assembly of the invention is employed. The winding machine comprises a main frame 130 having support 131, shown broken away, main frame 130 being provided with opposite bearings 132 at the top which serve as journals for horizontal shaft or winding spindle 134. Below and parallel with winding spindle 134 is cam shaft 136 journaled in bearings 138 at the sides of frame 130. Winding spindle 134 is the drive shaft of the machine, being driven by belt pulley 140 and adapted to be connected with winding spindle 134 by clutch member 142 fast in the shaft. Clutch member 142 is integral with belt pulley 144 which is connected by belt 146 to a similar pulley 148 located therebelow. Pulley 148 is fast with and drives shaft 150 journaled in bearing 152 in casing 154 at the side of main frame 130. At its inner end shaft 150 carries pinion 156 meshing with gear 158 in the end of shaft 136.

Fast on cam shaft 136 is cam 160 having helical groove 162 in its periphery which engages cam roller 116 on slide 114 which with the traverse rod 100 of the invention, reciprocates thread guide support 104. Slide 114 moves in a guideway in traverse frame 164, including back 112 and horizontal bar 166 supported from legs 168 pivoted on bushings 170 which serve as journals for cam shaft 136.

As seen above in FIGS. 1 and 2, traverse rod 100 is connected to slide 114 bearing bumpers 120 in upward projection 117 and carries thread guide support 104 at the other end. The back of the thread guide clamp 110 rides along back 112 of traverse frame 164. One bumper 120 impacts against frame 130 as seen in FIG. 4 and the other against frame 130 at the other end of the cycle or against strike plate 119 of suitable size as seen in FIGS. 3 and 4. Inasmuch as the cam shown in the Figures provides for reciprocation almost between frames one bumper 120 can be extended to strike the frame 130 with other cams of shorter traverse (not shown) strike plates are very desirable to absorb impact in cooperation with bumpers 120.

A tension device shown generally and diagramatically at 172 is attached to frame 130 and arranged so that yarn is drawn therethrough as it leads up from its supply source (not shown) therebelow. The yarn leads upward from 172 across thread bail 122 through slot 107 and is wound on cone 124 or whatever bobbin, tube or other spooling support is chosen. It will be understood that cone 124 is representative and not limiting.

The operation of the machine is controlled by starting lever 180 acting through rod 182 to disengage belt pullley 140 (the driving pulley) from clutch member 142. Automatic means may also be provided for stopping the machine if a yarn breaks. Such construction details are not pertinent to the present invention and are, moreover, well known to those of skill in the art.

Winding machines as shown in FIGS. 3 and 4 are usually constructed as units, i.e., as shown, several of which, suitably six, are combined on a single support 131, shown in part only. The several units are connected at the tops by horizontal tie rods shown in section at 184 passing through lugs 186 integral with frames 130.

The sound level reached in a mill where many winding machines, such as the above-mentioned Leesona 50, are operating is very high and may be of the order of 90 to 95 decibels or even more when measured by conventional equipment. In a large installation of several hundred spindles the noise level near one machine with six spindles when the machine is not in operation is 90 dcbls. Noise levels (decibels) are measured at the tips of cones and at 25 cm from the tips of cones under various conditions to demonstrate the high sound levels using standard parts and the reduction from use of instant parts for modifying one spindle. The data are summarized in Table I.

TABLE I

| Normal Operation | RPM | At Cone Tip | 25 cm From Tip |
|---|---|---|---|
| Spindle 1 | 1480 | 98.5 | 96 |
| Spindle 2 | 1485 | 100 | 96.5 |
| Spindle 3 | 1490 | 100.5 | 97 |
| Spindle 4 | 1490 | 100.5 | 97 |
| Spindle 5 | 1490 | 101 | 97 |
| Spindle 6 | 1480 | 100 | 96 |
| Operation with #1 remaining other shut down | | | |
| Spindle 1 | 1490 | 96.5 | 92 |
| Spindle 1 modified and running, others shut down | | | |
| Spindle 1 | | 92 | 90 |

Figure 5:
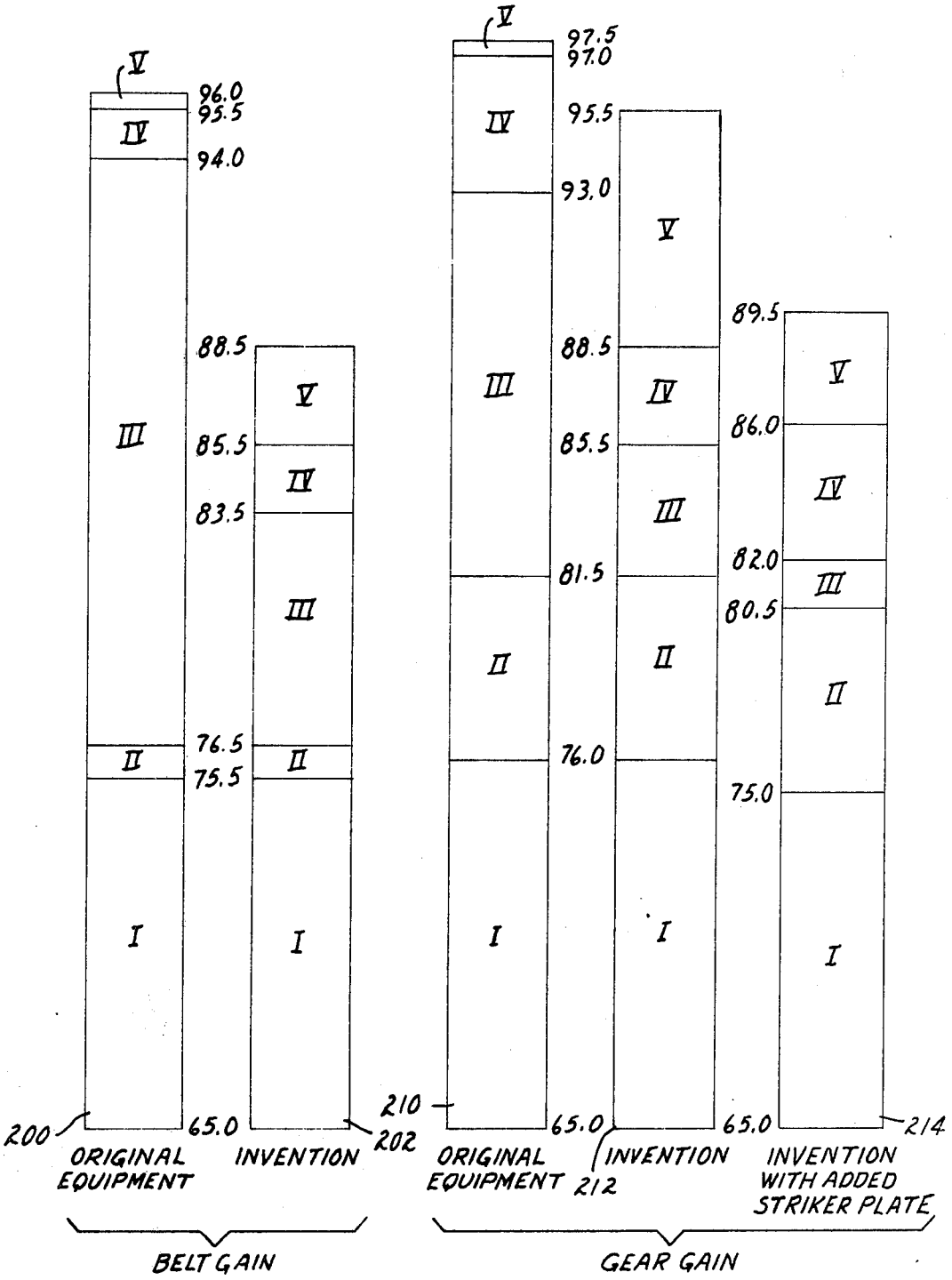

In FIG. 5 are shown bar graphs illustrating increments of noise measured at 2.5 cm from the end of a single spindle (not winding) in a room having a background noise below 50 decibels. The increments show noise level as measure as various portions of the mechanism are engaged as follows:

I. Motor and drive belt started,
II. Gain drive transmitting power to spindle engaged,
III. Slide and cam roll (alone) engaged,
IV. Traverse rod attached to slide,
V. Thread guide holder and support attached.

For convenience the decibel readings are indicated beside the bars. It is evident from the graphs that use of the slide and cam roll with traverse rod of the invention results in significant lowering of sound production which is further enhanced by use of a striker plate to receive the force of the bumper at the one end of the traverse.

The bars represent: spindle with belt gain and original equipment 200 or with traverse rod, slider and strike plate of the invention 202 and spindle with gear gain and original equipment 210 or with traverse rod and slider 212 or additional with impingement on a striker plate 214.

What is claimed is:

1. In a winding machine for winding yarn packages, having cam-operated means for traversing yarn lengthwise of the yarn package during the winding thereof and a traverse rod and a slider each of plastic material, said slider having a longitudinal hole and bearing a downwardly extending plastic cam roller, said traverse rod having bracket for attachment of thread guide supporting means at one end and distal thereto a reducing shoulder reducing the diameter of said traverse rod to a dimension to fit rotatably and be received in said longitudinal hole of said slider and means retaining said traverse rod rotatably in said slider, the improvement consisting essentially of said slider having an upward integral extension above said longitudinal hole and parallel thereto and a resilient elastomeric bumper of about 50 durometer test in each end of said extension for engagement with a fixed abutment on said machine at each end of the traverse of said slider.

2. The improvement of claim 1 wherein one of said abutments is a striker plate.

* * * * *